US006667110B1

(12) United States Patent
Cordonnier et al.

(10) Patent No.: US 6,667,110 B1
(45) Date of Patent: Dec. 23, 2003

(54) HYBRID STEEL CORD FOR TIRES

(75) Inventors: François-Jacques Cordonnier, Clermont-Ferrand (FR); Eric Depraetere, Thuret (FR)

(73) Assignee: Compagnie Générale des Establissements Michelin - Michelin & Cie, Clermont-Ferrand Cedex (FR)

( * ) Notice: Subject to any disclaimer, the term of this patent is extended or adjusted under 35 U.S.C. 154(b) by 0 days.

(21) Appl. No.: 09/395,232

(22) Filed: Sep. 13, 1999

Related U.S. Application Data

(63) Continuation of application No. PCT/EP98/01462, filed on Mar. 13, 1998.

(30) Foreign Application Priority Data

Mar. 14, 1997 (FR) ..... 97 03324

(51) Int. Cl.[7] ..... B32B 15/02; B60C 9/00

(52) U.S. Cl. ..... 428/544; 57/902; 152/451; 152/526; 152/527; 152/556; 152/557; 428/605; 428/648; 428/653; 428/656; 428/658; 428/659; 428/668; 428/676; 428/677; 428/679; 428/682; 428/683; 428/684; 428/685

(58) Field of Search ..... 428/544, 605, 428/648, 653, 656, 658, 659, 668, 676, 677, 679, 682, 683, 684, 685; 57/902; 152/451, 526, 527, 556, 557

(56) References Cited

U.S. PATENT DOCUMENTS

| | | | | |
|---|---|---|---|---|
| 4,788,815 A | * | 12/1988 | Umezawa | 57/902 |
| 6,418,994 B1 | | 7/2002 | Arnaud et al. | 152/556 |

FOREIGN PATENT DOCUMENTS

| | | |
|---|---|---|
| EP | 0648891 | 4/1995 |
| WO | WO9611812 | 4/1996 |

* cited by examiner

*Primary Examiner*—Robert R. Koehler
(74) *Attorney, Agent, or Firm*—Baker Botts L.L.P.

(57) ABSTRACT

A hybrid steel cord and method of making such cord which includes, in contact with one or more carbon steel wire(s), at least one stainless steel wire whose microstructure contains less than 20% of martensite (% by volume). Articles made of plastic and/or rubber, in particular tire envelopes or the carcass reinforcement plies of such envelopes embodying such cords.

23 Claims, No Drawings

HYBRID STEEL CORD FOR TIRES

BACKGROUND OF THE INVENTION

This is a continuation of EP98/01462, filed Mar. 13, 1998.

The present invention relates to steel cords intended in particular for the reinforcement of articles made of plastic and/or rubber, especially tire envelopes. It relates more particularly to cords for the reinforcement of the carcass of such tire envelopes.

More precisely, the invention concerns hybrid steel cords, i.e. ones comprising wires of steels of different types, the said cords having endurance greater than that of conventional steel cords for tires.

Conventional steel cords for tires have been described in numerous documents. In a known way, they consist of pearlitic (or ferritic-pearlitic) carbon steel tires, hereinafter referred to as "carbon steel", with carbon contents normally between 2% and 1.2% (% by weight), and whose diameters normally range from 0.10 to 0.50 mm (millimeters). Such wires are required to possess a very high tensile strength, generally of at least 2000 MPa and preferably more than 2500 MPa, obtained due to the structural hardening that takes place during the cold-drawing process. The wires are then assembled together in the form of cables or strands, and the steels used must therefore also possess sufficient ductility in torsion.

As is known, these steel cords are subjected to large stresses when the tires are rolling, notably to repeated bending or variations of curvature which cause the wires to rub against one another and undergo wear and fatigue (phenomena summarized by the term "fatigue-fretting"). Furthermore, the presence of humidity plays an important part by inducing corrosion and accelerating the above degradation process (a phenomenon known as "fatigue-corrosion") compared with utilization in a dry atmosphere. All these known fatigue phenomena, hereinafter summarized as "fatigue-fretting-corrosion", result in a progressive degeneration of the mechanical properties of the cords and, under the most severe rolling conditions, can affect their lifetime.

To improve the life of tire envelopes with a metallic carcass, in which repeated bending stresses can be particularly severe, patent application EP-A-648 891 proposed steel cords with improved endurance and corrosion resistance, consisting of stainless steel wires whose composition and microstructure confer upon these stainless steel wires both the tensile strength and the torsional ductility required to replace carbon steel wires; in particular, the microstructure of the stainless steel contains at least 20% and preferably at least 50% by volume of martensite.

Compared with conventional cords made with carbon steel wires, the cords made with such stainless steel wires with at least 20% by volume of martensite have improved endurance due to better resistance of the stainless steel wires to fatigue-fretting corrosion compared with the resistance shown by carbon steel-wires. This improved resistance considerably increases the tire life.

However, compared with the said conventional carbon steel wire cords, the cords according to EP-A-648 891 have the disadvantage of being expensive because of the composition of the steel and the process for obtaining the wires; the said application, moreover, suggests briefly that to reduce the cost, hybrid steel cords should be used consisting only in part of stainless steel wires with at least 20% by volume of martensite, while the remainder can consist of carbon steel wires.

The cost of these particular stainless steel wires is higher, mainly because of the additional transformation stages needed in order to obtain, by cold-drawing, a microstructure with a high martensite content. Besides, it is known that the more a stainless steel is transformed, notably by drawing, the more it hardens and the more difficult it becomes to transform at each subsequent stage; this may cause problems with the drawing dies, notably more rapid die wear, and so increase the wire-drawing costs.

All these disadvantages, taken together, of course have an adverse effect on the cost of the tires themselves.

SUMMARY OF THE INVENTION

The objective of the present invention is to reduce the above disadvantages by proposing new steel cords whose endurance is appreciably improved compared to that of conventional cords comprising only carbon steel wires, the endurance of the cords according to the invention being very close to that of the cords according to EP-A-648 891 mentioned earlier, the said cords being formed using specific stainless steel wires, but ones obtainable at definitely less cost.

The applicants found during the course of research that, surprisingly, the use of at least one stainless steel wire in a steel cord comprising carbon steel wires improves the fatigue-fretting-corrosion resistance of the carbon steel wires in contact with the stainless steel wire. The endurance properties of the steel cord itself are consequently globally improved, as also is the life of tires reinforced with such cords.

Due to this unexpected effect of the stainless steel wire, the hybrid cords of the invention can comprise a majority of carbon steel wires which bear most of the load, and only a limited number of stainless steel wires, or even just one, whose role is to improve the fatigue-fretting-corrosion resistance of the carbon steel wires by simple contact with them.

Furthermore, since the stainless steel wires no longer have to be load-bearing in contrast to those of the cords in the aforementioned application EP-A-648 891, an entirely advantageous result is that the initial stainless steel need no longer be severely transformed so as to obtain a microstructure with a high martensite content; neither is it necessary to use specific stainless steels capable of giving such a high-martensite microstructure after cold-drawing. Thus, stainless steel wires obtained by less costly processing methods can advantageously be used.

Consequently, a first object of the invention is a hybrid steel cord comprising, in contact with one or more carbon steel wire(s), at least one stainless steel wire whose microstructure contains less than 20% by volume of martensite.

A second object of the invention is the use, in a steel cord, of at least one stainless steel wire to improve by contact the fatigue-fretting-corrosion resistance of one or more carbon steel wire(s), this use being applicable with any type of stainless steel wire and not being limited in particular to a stainless steel wire whose microstructure contains less than 20% by volume of martensite.

Another object of the invention is a method for improving, in a steel cord, the fatigue-fretting-corrosion resistance of one or more carbon steel wire(s), characterized in that during the manufacture of the said cord, at least one stainless steel wire is incorporated in it by addition or substitution, such that the said stainless steel wire is in contact with the said carbon steel wire(s).

The invention also concerns the use of cords in accordance therewith for the reinforcement of articles made from plastic and/or rubber, for example pipes, belts, tire envelopes, and reinforcement plies designed notably to reinforce the crown or carcass of such envelopes.

The invention also concerns the said articles made of plastic and/or rubber themselves when reinforced with cords according to the invention, notably tire envelopes and their carcass reinforcement plies, more particularly when intended for commercial vehicles such as vans, trucks, trailers, underground vehicles, and equipment for transport, maintenance or civil engineering.

The invention will be readily understood from the description and embodiments below.

DESCRIPTION OF PREFERRED EMBODIMENTS

I. DEFINITION AND TESTS

I-1. Dynamometric Measurements

The measurements of breaking force, designated Fm (in N), tensile strength Rm (in MPa) and elongation after break A (in %) are carried out in tension in accordance with AFNOR method NF A 03-151 of June 1978.

I-2. Cold-drawing

By definition, the degree of deformation e is given by the formula:

$$\epsilon = Ln(S_i/S_f)$$

where Ln is the Naperian logarithm, $S_i$ is the initial cross-section of the wire before deformation and $S_i$ is its final cross-section after deformation.

I-3. Microstructure of the Steels

The identification and quantification of the microstructure of steels are carried out using a known X-ray diffraction technique.

This method consists in determining the total diffracted intensity for each phase in the steel, in particular α'-martensite, ϵ-martensite and γ-austenite, totalling the integrated intensity of all the diffraction peaks of the said phases, which enables calculation of the percentage of each phase relative to the total of all the phases present in the steel. The X-ray diffraction spectra are determined on the section of the wire to be examined using a goniometer, and with a chromium anticathode. Scanning makes it possible to obtain the characteristic lines of each phase present. In the case of the three aforementioned phases (the two martensites and austenite), the scan is carried out from 50 to 160 degrees.

To determine the integrated peak intensities, lines that interfere must be separated out. The following relation applies to each peak of any phase:

$$I_{int} = (L_{mh} \times I_{max})/P,$$

| | | | |
|---|---|---|---|
| where: | - | $I_{int}$: | integrated peak intensity |
| | - | $L_{mh}$: | mid-height width of the peak (in degrees) |
| | - | $I_{max}$: | peak intensity (counts per second) |
| | - | P: | measurement pitch of the peak (e.g. 0.05 degrees in 2θ). |

For example, there are the following characteristic lines:

| | | |
|---|---|---|
| γ-austenite | line (111) | 2θ = 66.8 |
| | line (200) | 2θ = 79.0 |
| | line (220) | 2θ = 128.7 |
| α'-martensite | line (110) | 2θ = 68.8 |
| | line (200) | 2θ = 106 |
| | line (211) | 2θ = 156.1 |
| ϵ-martensite | line (100) | 2θ = 65.4 |
| | line (002) | 2θ = 71.1 |
| | line (101) | 2θ = 76.9 |
| | line (102) | 2θ = 105.3 |
| | line (110) | 2θ = 136.2 |

The angle 2θ is the total angle in degrees between the incident beam and the diffracted beam.

The crystallographic structures of the above phases are as follows:

| | |
|---|---|
| γ-austenite: | face-centred cubic |
| α'-martensite: | body-centred cubic or tetragonal |
| ϵ-martensite: | close-packed hexagonal. |

The percentage by volume of a given phase "i" can then be calculated from the equation:

$$\%\ \text{of phase "}i\text{"} = I_i/I_t$$

where: –$I_i$=sum of the integrated intensities of all the peaks of this phase "i"

–$I_t$=sum of the integrated intensities of all the steel's diffraction phases.

| Thus, in particular: | |
|---|---|
| % of α'-martensite = | $I_{a'}/I_t$ |
| % of ϵ-martensite = | $I_\epsilon/I_t$ |
| total % of martensite = | $(I_{a'} + I_\epsilon)/I_t$ |
| % of γ-austenite = | $I_\gamma/I_t$ |

where: $I_{\alpha'}$=integrated intensity of all the α-martensite peaks $I_\epsilon$=integrated intensity of all the ϵ-martensite peaks $I_\gamma$=integrated intensity of all the γ-austenite peaks.

In what follows, the various percentages concerning the phases in the steel microstructure are expressed by volume, and the terms "martensite" or "martensite phase" cover the α' and ϵ martensite phases taken together. Thus, the term "% of martensite" represents the total volume percentage of these two martensitic phases and the term "austenite" represents γ-austenite. The volume percentages of the various phases determined as above are obtained with an absolute precision of around 5%. This means, for example, that below 5% by volume of martensite the microstructure of the steel can be regarded as virtually martensite-free.

I-4. Rotative Bending Test

The rotative bending test ("Hunter fatigue test") is a known fatigue test, described in U.S. Pat. No. 2,435,772 and used for example in EP-A-220 766 to test the fatigue-corrosion resistance of metallic wires intended as tire envelope reinforcement.

The test is usually applied to a single wire. In this description, the test is carried out not on an isolated wire but on the entire cord, so that the global resistance of the cord to fatigue-corrosion can be tested. Furthermore, the cord is not immersed in water as described in the aforementioned EP-A-220 766 for example, but exposed to the ambient air under an atmosphere of controlled humidity (relative humidity 60% and temperature 20° C.), since these conditions are closer to those encountered when the cord is used in a tire envelope.

The principle of the test is as follows: a specimen of the cord to be tested, of given length, is held at each end by two parallel grips. In one grip the cord can turn freely, while in the second grip, which is itself motor-driven, it is held fast. The bending of the cord enables a given bending stress a to be applied to it, whose intensity varies according to the radius of curvature imposed, itself a function of the useful length of the specimen (e.g. from 70 to 250 mm) and of the distance between the two grips (e.g. 30 to 115 mm).

To test the endurance of the cord pre-stressed in this way, the motorized grip is activated to make the cord undergo a large number of rotation cycles about its own axis, so that each point on the circumference of its cross-section is stressed alternately in tension and compression ($+\sigma$; $-\sigma$).

In practice the test is carried out as follows: a first stress $\sigma$ is chosen and the fatigue test is carried out for a maximum of $10^5$ cycles, at 3000 rotations per minute. Depending on the result obtained—breakage or non-breakage of the cord by the end of the maximum $10_5$ cycles—a new stress $\sigma$ is applied (lower or higher than before, respectively) to a new specimen, varying the stress or in accordance with the so-termed "up-and-down" method (Dixon & Mood: Journal of the American Statistical Association, 43, 1948, 109–126). In this way a total of 17 iterations are carried out. The statistical treatment of the tests defined by this up-and-down method allows determination of an endurance limit—designated $\sigma_d$—which corresponds to a cord fracture probability of 50% at the end of the $10^5$ fatigue cycles. For example, the stress a applied during this series of iterations, for a cord of formula (1×3) consisting of three steel wires with diameter about 0.18 mm (such as cords C-1 to C-7 in the examples below), can range from 200 to 1500 MPa.

For this test a rotary bending machine manufactured by Bekaert, model-type RBT is used, fitted with an electric breakage detector. By "breakage of the cord" is meant the breakage of at least one wire constituting it.

The formula for calculating the stress a is as follows:

$$\sigma=1.198E\phi/C$$

where E is the Young's modulus of the material (in MPa), $\phi$ is the diameter of the broken wire (in mm) and C is the distance (in mm) between the two grips(C=Lo/2.19, where Lo is the useful length of the specimen).

I-5. Belt Test

The "belt" test is a known fatigue test described, for example, in application EP-A-362 570 or in the aforementioned EP-A-648 891. The steel cords to be tested are incorporated in a rubber article which is then vulcanized.

Its principle is as follows: the rubber article is an endless belt made from a known, rubber-based mixture similar to those currently used for tire envelope carcasses. The axis of each cord is orientated in the longitudinal direction of the belt and the cords are separated from the belt's surfaces by a depth of rubber of approximately 1 mm. When the belt is arranged so as to form a cylinder of revolution, the cord forms a helical coil with the same axis as the cylinder (e.g. with the pitch of the helix approximately 2.5 mm).

The said belt is then subjected to the following stresses: it is turned around two pulleys so that every elementary portion of each cord is subjected to a tensile stress of 12% of the initial breaking force, and undergoes curvature variation cycles ranging from infinite radius to a radius of 40 mm, for 50 million cycles. The test is carried out under a controlled atmosphere, at approximately 20° C. and 60% relative humidity. The duration of stressing for each belt is around 3 weeks. At the end of this stressing, the cords are extracted from the belts by decortication and the residual breaking force of the fatigued cord wires is determined.

In addition, a belt identical to the above is made and its cords decorticated in the same way as before, but this time without subjecting the cords to the fatigue test. These are used to determine the initial breaking force of the wires of un-fatigued cords.

Finally. the decrease of the breaking force after fatigue (designated $\Delta$Fm and expressed in %) is calculated by comparing the residual and initial breaking forces.

In a known way, this deterioration $\Delta$Fm is due to the fatigue and wear of the wires caused by the conjoint action of stress and moisture in the ambient air, these conditions being comparable with those to which reinforcement cords in tire envelope carcasses are subjected. The belt test carried out in this way is therefore a means of measuring the fatigue-fretting-corrosion resistance of the wires constituting the cords incorporated in the belt.

II. EXAMPLE EMBODIMENTS

In all of what follows, unless specifically otherwise indicated, all percentages indicated are percentages (%) by weight.

II-1. Nature and Properties of the Steel Wires

To produce examples of cords which do and do not conform to the invention, thin drawn steel wires are used whose diameter ($\phi$ varies between about 0.17 and 0.20 mm, the said wires being either of carbon steel on stainless steel.

The chemical compositions of the initial steels are given in Table 1 below, the steel designated "T" being the carbon steel, a known pearlitic steel with 0.7% of carbon (USA Standard AISI 1069) and those designated "A", "B" or "C" being stainless steels of various types (USA Standards AISI 316, 202 or 302). The values indicated for each of the elements mentioned (C, Cr, Ni, Mn, Mo, Si, Cu, N) are in % by weight, the remainder of each steel being iron with the usual unavoidable impurities, and the presence of a dash (-) in Table 1 indicates that the corresponding element is only present in residual amounts if at all. In all this, "stainless steel" means a steel containing at least 11% of chromium and at least 50% of iron (total % by weight of the stainless steel).

Starting from the four steels above (T, A, B and C) and by varying the final drawing ratios of the wires, two groups of wires with different diameters are made: a first group of wires with mean diameter equal to about 0.200 mm for the wires designated as 1 (wires T1, A1, B1 and C1) and a second group of wires with mean diameter about 0.175 mm for the wires designated as 2 (wires T2, A2. B2. C2).

To prepare the above steel wires, known methods are used such as those described for example in the aforementioned application EP-A-648 891, starting with commercial wires whose initial diameter is about 0.8 mm for steel A, 0.6 mm for steel B, and 1 mm for steels C and T.

All these wires are subjected to known degreasing and/or pickling processes before later use, and the stainless steel wires are in addition electroplated with a nickel layer about 0.3 $\mu$m (micrometers) thick.

At this stage the wires have a tensile strength of around 675 MPa (steel A), 975 MPa (steel B), 790 MPa (steel C) and 1150 MPa (steel T). Their elongations after break are 35–45% for the stainless steel wires and around 10% for the carbon steel.

Each wire is then electroplated with copper and then with zinc at ambient temperature, and the wires are then heated by the Joule effect to 540° C. to obtain brass by interdiffusion of the copper and zinc, the weight ratio (phase $\alpha$/phases $\alpha+\beta$) being approximately 0.85. No heat treatment is applied to the wire once the brass coating has been obtained.

Each wire is then finally cold-drawn (i.e. after the final heat treatment) in a humid medium with a grease presented in a known way in the form of a water emulsion. This wet drawing is carried out in a known way to obtain the final degrees of deformation $\epsilon$ noted in Table 2, $\epsilon$ being calculated from the initial diameter indicated earlier for the original commercial wires.

The steel wires so drawn have the mechanical properties shown in Table 2, and their diameters range from 0.171 to 0.205 mm. The coating of brass (plus nickel, if present) surrounding the wires is very thin indeed, certainly below one micrometer and, for example, of the order of 0.15 to 0.30 $\mu$m (about 0.05 $\mu$m of which is nickel, if present), which is negligible compared with the diameter $\phi$ of the steel wires.

The wires A1 and B1 on the one hand, and A2 and B2 on the other hand, have no martensite or contain less than 5% of it (by volume). The wires C1 and C2 have high martensite contents (over 60% by volume) and correspond to the stainless steel wires of the aforementioned EP-A-648 891. Of course, the composition of the final wire steel in terms of its elements (e.g. C, Cr, Ni, Mn, Mo) is the same as that of the initial wire steel.

It should be remembered that during the wire-making process, the brass coating facilitates the drawing of the wire and improves the adhesion of the wire to the rubber when the wire is used in a rubber article, notably in a tire envelope. As for the nickel coating, this makes for good adhesion of the brass coating to the stainless steel.

II-2. Production of the Cords

When used in the present description to describe the cords, the terms "formula" or "structure" refer to the construction of the cords.

The above wires are then assembled to make cords, either in the form of elementary strands or in the form of layered cords. The cords, whether or not conforming to the invention, are prepared using procedures and twisting or cabling equipments known to those familiar with the field, which are not described here for the sake of simplicity.

a) Cords (1×3)

Starting from the wires T2, A2, B2, C2 of Table 2, known twisting methods are used to make 7 steel cords of known structure or formula designated as (1×3), each consisting of an elementary strand with three wires twisted into a spiral (direction S) with a 10 mm pitch in one step, i.e. during a single twisting operation.

These cords are designated C-1 to C-7 and were prepared using the various combinations indicated in square brackets in Table 3. The mechanical properties of these cords C-1 to C-7 are also shown in Table 3.

Cord C-1, with structure [3T2] (i.e. consisting of 3 T2 wires) is the only cord consisting entirely of carbon steel wires, and which does not therefore conform to the invention. Thus, it constitutes the "control" cord for the present series. To manufacture cords comprising 1 or 2 stainless steel wires, compared with this control cord one simply replaces 1 or 2 T2 carbon steel wires with 1 or 2 stainless steel wires, such that the surface(s) of the latter is/are placed in contact with the surface(s) of the other carbon steel T2 wire(s) making up the cord.

The cords C-2 to C-7 are therefore all hybrid steel cords containing either just one stainless steel wire (cords C-2, C-3 and C-4), or two stainless steel wires (cords C-5, C-6 and C-7). For example, cord C-2 of formula (2T2+1A2) is formed of 2 carbon steel T2 wires in contact with one stainless steel (AISI 316) A2 wire, while cord C-7 of formula [1T2+2C2] consists of one carbon steel T2 wire in contact with two stainless steel (AISI 302) C2 wires.

The hybrid cords C-2 and C-3 on the one hand, and C-5 and C-6 on the other hand, are cords which conform to the invention, since the microstructure of their stainless steel wires contains less than 20% by volume of martensite.

Also in conformity with the invention is the use of each stainless steel wire (A2, B2 or C2) in cords C-2 to C-7 to improve, by contact, the fatigue-fretting-corrosion resistance of the carbon steel wires (T2), since in effect the invention covers the use of any stainless steel wire, including wire C2 whose microstructure contains over 70% by volume of martensite.

b) Cords (1+6+12)

Starting with the previous two groups of wires (T1, A1, B1and C1 on the one hand, T2 on the other hand), a cabling machine is used to make 4 layered cords of known structure designated as (1+6+12), in which a central core consisting of a single wire is surrounded by and in contact with a first, internal layer of six wires, itself surrounded by and in contact with a second, external layer of twelve wires.

This type of layered cord is particularly designed for the reinforcement of an industrial tire carcass. It consists of a strand of 19 wires in all, one serving as the core and the other 18 being twisted around this core in two adjacent concentric layers. A particular example of such a cord structure was described in the aforementioned application EP-A-362 570.

In these cords, only the nature of the core wire varies, being either of stainless steel or of carbon steel. The diameter of the core wire is about 0.200 mm, corresponding to the wires indexed 1. The two layers surrounding the core have the same helical pitch of 10 mm and the same direction of winding, (Z), and comprise in all 18 carbon steel wires of diameter 0.175 mm (wire T2).

Thus, to each cord core there corresponds one steel variant from Table 1. These cords are designated C-11 to C-14 and were prepared in accordance with the various constructions indicated in square brackets in Table 4. Cord C-11, of structure [1T1+6T2+12T2] is the only one consisting entirely of carbon steel wires, and is therefore the control cord for this series. The cords designated C-12 to C-14 are all hybrid steel cords with a stainless steel core wire: for example, cord C-12 of construction [1A1+6T2+12T2] is formed with IAI stainless steel (AISI 316) wire in contact with six carbon steel T2 wires forming the first, internal layer itself surrounded by a second, external layer of 12 T2 wires.

The mechanical properties of these cords are also indicated in Table 4. The breaking forces of the various cables are seen to be almost the same, even when the strength of the stainless steel wires (wires A and B) is lower. This is because of the very small proportion of stainless steel wire used (Oust one stainless wire out of 19 wires in all).

The hybrid cables C-12 and C-13 conform to the invention, the microstructure of the stainless steel of their wires having less than 20% by volume of martensite.

Also in accordance with the invention is the use of any of the stainless steel wires (A1, B1 or C1) in the cords C-12 to C-14 to improve, by contact, the fatigue-fretting-corrosion resistance of the carbon steel T2 wires forming the internal layer, since in effect the invention covers the use of wire C1 whose microstructure contains over 60% by volume of martensite.

The method of improving the fatigue-fretting-corrosion resistance of the carbon steel T2 wires of the internal layer in steel cords C-12 to C-14 also conforms to the invention, since that method consists in making the said cables by incorporating, in place of a carbon steel wire core, a stainless steel wire core and so bringing the surface of the latter in contact with the surfaces of the 6 T2 carbon steel wires surrounding the stainless steel wire core.

c) Cords(1+6+11)

Starting with the previous groups of wires (T1 and B1 on the one hand, and T2 on the other hand) and using the same cabling machine as before, 2 layered cords of known structure (1+6+11) are made, also intended particularly for the reinforcement of an industrial tire carcass, in which a central core consisting of a single wire is surrounded by and in contact with a first, internal layer of six wires, itself surrounded by and in contact with a second, external layer of eleven wires. These layered cords thus consist of a strand with 18 wires in all, one serving as the core and the other 17 being twisted around this core in two adjacent concentric layers, the last of which is referred to as unsaturated.

In these cords, only the nature of the core wire varies, being either of stainless steel (core B1) or of carbon steel (core T1). The diameter of the core wire is about 0.200 mm, corresponding to the wires indexed 1. The first layer around the core has a helix pitch of 5.5 mm and the second (external) layer a helix pitch of 11 mm; the two layers are twisted in the same direction (Z) and consist of 17 carbon steel wires in all, of diameter 0.175 mm (T2).

These cords are designated C-15 and C-16, and were made up to the respective constructions given in square brackets in Table 4. Cord C-15, of construction [1T1+6T2+11T2] is the only cord made entirely from carbon steel wires and is therefore the control cord for the series. The hybrid steel cord designated C-16, of construction [1B1+6T2+111T2], is formed with one B1 stainless steel (AISI 202) wire in contact with six carbon steel T2 wires forming the first, internal layer itself surrounded by a second, external and unsaturated layer of eleven T2 wires. The mechanical properties of these cords, also shown in Table 4, are virtually the same owing to the very small proportion of stainless steel wire used (just 1 stainless wire out of a total of 18).

The cord C-16 conforms to the invention since the microstructure of the stainless steel of its core wire contains less than 5% by volume of martensite. Also in conformity with the invention is the use of the stainless steel wire (B1) in cord C-16 to improve by contact the fatigue-fretting-corrosion resistance of the carbon steel T2 wires forming the internal layer. The method of improving the fatigue-fretting-corrosion resistance of the carbon steel T2 wires of the internal layer in cord C-16 also conforms to the invention, since that method consists in making the said cord by incorporating in place of a carbon steel wire core, a stainless steel wire core and so bringing the latter in contact with the 6 T2 carbon steel wires surrounding the stainless steel wire core.

II-3. Endurance of the Cords

A) Rotative Bending Test

The purpose of this test is to demonstrate the improved endurance of hybrid steel cords, in particular in a humid atmosphere, when they consist in part of stainless steel wires while the remainder consists of carbon steel wires. Cords C-1 to C-7 were subjected to the rotative bending test described in section 1-4. The results are shown in Table 5; it was noted that in all cases it was a carbon steel wire which broke.

The stress ad is the endurance limit corresponding to a breakage probability of 50% under the test conditions: it is given both in absolute units (MPa) and relative units (r.u.). A clear improvement is noted for all the examples conforming to the invention, ad being higher by 10 to 20% in cords C-2 to C-7 than in the control cord C-1 containing only carbon steel wires. Besides, visual examination of the various wires in the cords tested showed that wear phenomena were virtually absent in all cases, and that consequently the improved results were attributable to increased fatigue-corrosion resistance of the carbon steel wires.

Furthermore, after the test no particular traces of corrosion were observed in cords C-2 to C-7 on the carbon steel wires in contact with the stainless steel wires: this result is unexpected for one familiar with the field, who might fear that in so humid an environment accelerated and very damaging corrosion would affect the carbon steel wires precisely because of the presence of the stainless steel wires, leading to the so-termed "galvanic" or "bimetallic" effects which are well known in metallurgy.

The test was carried out on elementary 3-wire strands, but it goes without saying that the invention concerns any type of elementary strand of formula (1×N) consisting of a single group of N wires (N≧2) twisted together in a helix in a single cabling operation, and having in contact with one or more carbon steel wire(s) at least one stainless steel wire whose microstructure contains less than 20% by volume of martensite. In such a strand, N could reach several tens of wires, for example 20 to 30 wires or more; for preference, N ranges from 2 to 5.

Of course, the invention also concerns any stranded cord of simple formula (i.e. containing a small number of wires) of the type (P+Q)—with P≧1, Q≧1, and preferably with P+Q ranging from 3 to 6—obtained by assembling at least one elementary strand (or single wire) with at least one other elementary strand (or single wire), the wires in such a stranded cord of formula (P+Q) then not being twisted together in a helix during a single twisting operation, in contrast with the strand said to be elementary (1×N) described earlier, for example, strands with the formulas (2+1), (2+2), (2+3) or even (2+4) may be mentioned.

The invention also concerns any steel multi-strand cord (assembly of several strands) at least one of which conforms to the invention, as well as the use of a stainless steel wire, in such a multi-strand cord, to improve by contact the fatigue-fretting-corrosion resistance of carbon steel wires.

B) Belt Test

The purpose of this test is to demonstrate the increased resistance to fatigue-fretting-corrosion of carbon steel wires in hybrid steel cables made using carbon steel wires and stainless steel wires, due to the contact between the carbon steel and the stainless steel.

It should be noted here that the various very thin coatings that can be present on the stainless steel or carbon steel wires, such as the nickel and/or brass coatings described earlier, have no influence on the results of the belt test since the said coatings are removed very quickly, during the first few cycles of rubbing between the wires.

1) Cords (1+6+12):

Cords C-11 to C-14 were subjected to the belt test described in section I-5, with determination of the initial and residual breaking forces (mean values) for each type of wire, depending on the position of the wire in the cord and for each of the cords tested. The decrease ΔFm is given in % in Table 6, for the core wires (level marked N0). The wires of the first, internal layer (level marked N1) and the wires of the second, external layer (level marked N2). The global decreases ΔFm were also determined for the cords themselves and not for the wires in isolation.

An inspection of Table 6 reveals the following:

- the deterioration of the stainless steel core wires (level N0; ΔFm=0 to 5.1%) is much smaller than that of the carbon steel core wire (ΔFm=29.4%); this is observed regardless of which stainless steel wire is used, i.e. even when the stainless steel's microstructure is virtually martensite-free (less than 5% by volume for cords C-12 and C-13), which is already an unexpected result;
- even more surprisingly, the carbon steel wires of the internal layer (layer N1)—which in the cord were in contact with a stainless steel core wire—resisted the test much better: their decrease ΔFm (8.7 to 10.4%) is on average 60% less than that of the wires in the same (N1) layer of the control cord C-11 (23.7%); here too it is evident that the improvement is approximately the same no matter what type of stainless steel is used, i.e. whether or not the latter contains martensite;
- all the above improvements are reflected by the performance and endurance of the cords themselves: the global decrease ΔFm of cords C-12 to C-14 (8.4 to 10.4%) is 30% less than that of the control cord (15.2%);
- finally, the deterioration of the wires in the second layer (level N2) is essentially the same (ΔFm between 8.8 and 11%) whichever the cord tested, as expected since the environment of those wires was the same regardless of the cord tested.

In correlation with the above results, visual inspection of the various wires shows that the wear phenomena resulting from the repeated rubbing of the wires against one another are clearly less marked in cords C-12 to C-14: this is true not only for the stainless steel core wire with a high martensite content, but also for the other stainless steel core wires with virtually no martensite in their microstructure; what is more, and surprisingly, the same reduced wear is found in the carbon steel wires of the internal (N 1) layer, whose surface was in contact with that of the stainless steel core wire.

2) Cords (1+6+11):

Cords C-15 and C-16 were subjected to the belt test under the same conditions as before. The decrease ΔFm is given in % in Table 6 for the core wires (level N0), the first, internal-layer wires (N1) and the second, external-layer wires (N2). The global decreases ΔFm were determined on the cords themselves and not on the wires taken in isolation.

Examination of Table 6 shows results as good as the previous ones, namely:

- the deterioration of the stainless steel core wire (level N0; (ΔFm=3.7%) is much less than that of the carbon steel core wire (ΔFm=15.8%);
- the carbon steel wires of the internal (N1) layer—which were in contact with the stainless steel core wire in the cord—resisted the test much better: their decrease ΔFm (8.3%) is on average half as much as that of the same N1 layer in the control cord C-15 (15.5%) with the carbon steel core wire;
- finally, the deterioration of the second layer (level N2) is essentially the same (ΔFm=9 or 11%) no matter which cord is tested, as expected since the environment of those wires is the same whether or not the cord conforms to the invention.

As in the previous test, visual inspection of the various wires shows that the wear phenomena resulting from the repeated rubbing of the wires against one another are clearly less marked in cord C-16 compared with C-15; this applies not only to the stainless steel core wire whose microstructure is virtually martensite-free, but also, and surprisingly, to the internal-layer (N1) carbon steel wires which were in contact with the stainless steel core wire.

Thus, the presence of a stainless steel core wire, by unexpectedly reducing the fatigue phenomena between the core and the first-layer wires, improves the overall behaviour of the steel cord. Moreover, the reduced wear between the core and the first layer has the advantageous result of reducing the risk of blocking between the wires and the resultant tensile stress imbalance.

These tests described layered cords of structure (1+6+12) and (1+6+11) but the invention also concerns all types of layered cords, whether wrapped or not, which comprise in contact with one or more carbon steel wire(s) at least one stainless steel wire whose microstructure contains less than 20% by volume of martensite, such a layered cable possessing in particular the general structure (X+Y+Z) with a core of X wire(s) surrounded by and in contact with at least one first layer of Y wires, itself possibly surrounded with a second layer of Z wires, where for preference X ranges from 1 to 4, Y from 3 to 12 and Z from 8 to 20, as the case may be.

For example, in such a cord the first layer (saturated or unsaturated) could have Y=4,5 or 6 wires if X=1, Y=6,7 or 8 if X=2, Y 8,9 or 10 if X=3, Y=9, 10 or 11 if X=4, and this first layer could be the only one (when Z=0) or, on the contrary, it could itself be surrounded by a second layer (saturated or unsaturated) comprising Z wires, for example with Z=11 or 12 if Y=6, Z=12 or 13 if Y=7, Z=13 or 14 if Y=8, Z=14 or 15 if Y=9, and the pitches and/or the twist directions and/or the diameters of the wires being the same or different from one layer to the other, such a cable also if needs be being wrapped with a wire wound in a spiral around the final layer.

In a layered cord of this kind, according to a preferred embodiment of the invention, the central core consists of one or more stainless steel wire(s) surrounded by and in contact with at least a first layer of carbon steel wires. In particular, the advantage of a layered cord whose core consists of a single stainless steel wire, such as the cords with formulas (1+6+12) or (1+6+11) described in the preceding tests, should he emphasized: since the core wire, granted its position in the cord, is stressed less during the cord-making operation, it is not necessary to use particular stainless steel compositions for that wire which have a high torsional ductility.

Another known problem concerning the use of stainless steel wires in cords for tires is related to the fact that the brass, used to improve the adhesion of the cord to the rubber, is generally more difficult to deposit on a stainless steel wire than on a carbon steel wire, which is why it is necessary to deposit an intermediate layer, for example a layer of nickel. Now, for a layered cord with only one stainless steel core which, therefore, will generally not be in direct contact with the rubber, the brass and nickel plating operations can be omitted and this reduces the costs of producing and using the stainless steel wires. The wire can then be simply dry-drawn or wet-drawn in a mineral oil.

C) Tests in Tires

The purpose of this test is to show that the use in a steel cord of just one stainless steel wire in contact with two carbon steel wires, to improve the fatigue-fretting-corrosion resistance of the latter and hence the endurance of the cord itself, allows the life of the tire carcass envelope to be increased considerably, whether or not the microstructure of the stainless steel contains martensite.

In this test four tire envelopes P-1, P-2, P-3 and P-4 are produced, whose radial carcass, consisting of a single radial ply, is reinforced respectively with the cords C-1, C-2, C-3 and C-4. The envelope P-1 then constitutes the control envelope for these tests. The envelopes are fitted to known and identical wheel-rims and inflated to the same pressure with moisture-saturated air. The envelopes are then rolled on an automatic rolling machine under the same overload and at the same speed, until the cords break (rupture of the carcass reinforcement).

It is then found that the various envelopes have "travelled" the following distances (taking the base 100 for the control envelope):

P-1: 100

P-2: 220

P-3: 280

P-4: 220.

The envelopes reinforced according to the invention thus travel a distance from two to nearly three times greater than the control envelope.

Consequently, as shown by the various example embodiments described earlier, the invention considerably increases the endurance of the steel cords for the reinforcement of plastic and/or rubber articles, in particular tire envelopes, and the lifetime of those articles themselves. In the said steel cords, by placing the surface of a carbon steel wire in contact with that of a stainless steel wire, even when very thin or ultra-thin coatings are present on the surface of the wires, the fatigue-fretting-corrosion resistance of the carbon steel wire is improved in an unexpected way.

This therefore provides a means of increasing the life of steel cords for tires and that of the tires they are used to reinforce, at less cost and indeed at negligible extra cost in some cases.

Whereas in EP-A-648 891 the stainless steel wires were used because of their own specific tensile strength and fatigue and corrosion resistance properties, according to the present invention the stainless steel wires are only being used to improve, by contact, the fatigue resistance properties of the other, carbon steel wires with which they are combined to form the cord.

The tensile strength of the cords of the invention can therefore be conferred essentially by the carbon steel wires, preferably present in a majority. The stainless steel wires themselves contribute only slightly or almost negligibly to the tensile strength of the cords, and the mechanical properties of the stainless steel wires are therefore not critical. They are not critical in the sense that the composition and microstructure of the stainless steel are no longer dictated, as was the case in cords made with stainless steel wires according to the prior art, by mechanical strength requirements. A large range of stainless steel compositions is thus possible, so that constraints related to the cost and method of obtaining the wires can be optimized.

For preference, according to the invention, the steels of the wires, used in the cords will conform with at least one of the following characteristics:

the carbon steel comprises between 0.5% and 1.0%, more preferably between 0.68% and 0.95% of carbon, these concentration ranges representing a good compromise between the mechanical properties required for the tire and the feasibility of the wire; it should be noted that in applications where the mechanical strength need not be as high as possible, whether in tires or not, the carbon steels used can advantageously have carbon contents between 0.50% and 0.68%. notably 0.55% to 0.60%, and ultimately such steels are less costly since easier to wire-draw;

the stainless steel comprises less than 0.2% of carbon (to facilitate transformation), between 16% and 20% of chromium (a good compromise between the cost of the wire and its corrosion properties), less than 10% of nickel and less than 2% of molybdenum (so as to limit the cost of the wire);

more preferably, the stainless steel comprises less than 0.12% of carbon, between 17% and 19% of chromium and less than 8% of nickel, the carbon content being more preferably still equal to 0.08% (for the same reasons as above).

For preference, the cord of the invention will have at least one of the following characteristics:

the microstructure of the stainless steel contains less than 10%, more preferably less than 5% of martensite or even none at all (% by volume), since such steels are less costly and easier to transform;

for a good compromise between strength, bending endurance and feasibility, the steel wires have a diameter $\phi$ between 0.10 and 0.45 mm, more preferably between 0.12 and 0.35 mm when the cord is intended to reinforce a tire envelope; more preferably still, the steel wires have diameter $\phi$ ranging from 0.15 to 0.25 mm, particularly when the cord is intended to reinforce the carcass of a tire envelope;

the final degree of deformation e of the carbon steel wires is greater than 2.0 and preferably greater than 3.0;

the tensile strength of the carbon steel wires is at least equal to 2000 MPa and preferably greater than 2500 MPa;

at least 50% and preferably the majority of the steel wires are carbon steel wires; still more advantageously, at least two-thirds (⅔) of the steel wires are carbon steel wires;

each carbon steel wire is in contact with at least one stainless steel wire.

For the reinforcement of industrial tire carcasses, the invention is preferably applied using cords of structure (1+6+12) or (1+6+11), in particular when only the core wire is made of stainless steel.

Of course, the invention is not limited to the example embodiments described above.

For example, the invention concerns any multi-strand hybrid steel rope whose structure incorporates at least one strand conforming to the invention, in particular at least one strand with a formula of the types described earlier, i.e. (1×N), (P+Q) or (X+Y+Z).

The invention also concerns any multi-strand hybrid steel rope at least one strand of which is made of stainless steel (i.e. consisting of stainless steel wires) and is in contact with one or more strand(s) of carbon steel (i.e. consisting of carbon steel wires), and the invention also concerns the use of at least one stainless steel strand in such a multi-strand rope, to improve by contact the fatigue-fretting-corrosion endurance of the carbon steel wires making up the other strands.

In the above examples, the stainless steel wires had a nickel coating and were also coated with brass before the final wire-drawing, but other production methods are possible, for example the nickel can be replaced by some other metal such as copper, zinc, tin, cobalt or alloys of one or more of these. On the other hand, the nickel was deposited in a relatively thick layer (approximately 0.3 μm before drawing), but ultra-thin layers are sufficient, obtained for example by the so-termed "flash" deposits (e.g. of thickness 0.01 to 0.03 μm before drawing, that is 0.002 to 0.006 μm after drawing).

The final drawing could also be carried out on a "bright" wire, i.e. one with no metallic coating, whether for a stainless or for a carbon steel wire. It has been found that the results of the belt test and the rotation bending test are essentially the same whether the stainless or carbon steel wires are bright or, on the contrary, coated with their respective coatings.

Of course, the carbon steel wires could themselves also be coated with a thin metallic layer other than brass, whose function for example would be to improve their corrosion resistance and/or their adhesion to rubber, for example a thin layer of Co, Ni, Zn, Al, Al—Zn alloy, or an alloy of two or more of the elements Cu, Zn, Ni, Co, Sn such as a ternary Cu—Zn—Ni alloy containing in particular 5 to 15% of nickel, the said metallic layer being obtained notably by "flash" deposition techniques as described earlier.

The hybrid steel cords of the invention may, on the other hand and without departing from the scope of the invention, contain wires of different diameters or natures, for example stainless steel wires of different composition or carbon steel wires of different composition; they can also contain metal wires other than carbon steel or stainless steel wires in addition to the latter two, or even non-metallic fibers such as mineral or organic fibers. The cords of the invention can also contain pre-formed wires, for example undulating ones designed to aerate the structure of the cords to a greater or lesser extent and increase their permeability by plastic and/or rubber materials, and the pre-formation or undulation periods of such wires may be smaller than, equal to or larger than the twist-pitch of the cords themselves.

TABLE 1

| Steel | AISI | C | Cr | Ni | Mn | Mo | Si | Cu | N |
|---|---|---|---|---|---|---|---|---|---|
| T | 1069 | 0.7 | — | — | 0.5 | — | 0.2 | — | — |
| A | 316 | 0.03 | 17.5 | 12.6 | 0.7 | 2.4 | 0.5 | 0.2 | 0.03 |
| B | 202 | 0.08 | 18.1 | 5.4 | 9.2 | — | 0.6 | — | 0.03 |
| C | 302 | 0.08 | 18.4 | 8.8 | 0.9 | 0.2 | 0.7 | 0.4 | 0.05 |

TABLE 2

| Wire | Steel | $\epsilon$ | $\phi$ | Martensite (%) | Fm (N) | A (%) | Rm (MPa) |
|---|---|---|---|---|---|---|---|
| $T_1$ | T | 3.2 | 0.200 | 0 | 82 | 1.0 | 2625 |
| $A_1$ | A | 2.7 | 0.205 | <5 | 61 | 1.7 | 1839 |
| $B_1$ | B | 2.2 | 0.203 | <5 | 67 | 2.4 | 2057 |
| $C_1$ | C | 3.2 | 0.199 | >60 | 78 | 1.1 | 2502 |
| $T_2$ | T | 3.5 | 0.175 | 0 | 69 | 1.0 | 2876 |
| $A_2$ | A | 3.1 | 0.174 | <5 | 43 | 1.6 | 1793 |
| $B_2$ | B | 2.5 | 0.173 | <5 | 50 | 2.1 | 2118 |
| $C_2$ | C | 3.5 | 0.171 | >70 | 62 | 1.0 | 2876 |

TABLE 3

| Cord | Construction | Fm (N) | A (%) | Rm (MPa) |
|---|---|---|---|---|
| C-1 | [3 T2] | 202 | 1.9 | 2835 |
| C-2 | [2 T2 + 1 A2] | 177 | 1.5 | 2489 |

TABLE 3-continued

| Cord | Construction | Fm (N) | A (%) | Rm (MPa) |
|---|---|---|---|---|
| C-3 | [2 T2 + 1 B2] | 185 | 2.0 | 2595 |
| C-4 | [2 T2 + 1 C2] | 197 | 1.8 | 2760 |
| C-5 | [1 T2 + 2 A2] | 146 | 1.6 | 2209 |
| C-6 | [1 T2 + 2 B2] | 168 | 1.9 | 2368 |
| C-7 | [1 T2 + 2 C2] | 191 | 1.8 | 2680 |

TABLE 4

| Cord | Construction | Fm (N) | A (%) | Rm (MPa) |
|---|---|---|---|---|
| C-11 | [1 T1 + 6 T2 + 12 T2] | 1237 | 1.8 | 2628 |
| C-12 | [1 A1 + 6 T2 + 12 T2] | 1243 | 1.6 | 2635 |
| C-13 | [1 B1 + 6 T2 + 12 T2] | 1245 | 1.9 | 2680 |
| C-14 | [1 C1 + 6 T2 + 12 T2] | 1275 | 1.9 | 2705 |
| C-15 | [1 T1 + 6 T2 + 11 T2] | 1177 | 2.2 | 2683 |
| C-16 | [1 B1 + 6 T2 + 11 T2] | 1116 | 1.8 | 2536 |

TABLE 5

| Cord | $\sigma_d$ (MPa) | $\sigma_d$ (r.u.) |
|---|---|---|
| C-1 | 400 | 100 |
| C-2 | 454 | 114 |
| C-3 | 438 | 110 |
| C-4 | 445 | 111 |
| C-5 | 475 | 119 |
| C-6 | 468 | 117 |
| C-7 | 478 | 120 |

TABLE 6

| | ΔFm (%) | | | |
|---|---|---|---|---|
| Cord | N0 | N1 | N2 | Cord |
| C-11 | 29.4 | 23.7 | 9.4 | 15.2 |
| C-12 | 5.1 | 8.7 | 9.4 | 9 |
| C-13 | 0 | 9.3 | 8.8 | 8.4 |
| C-14 | 0.6 | 10.4 | 11 | 10.4 |
| C-15 | 15.8 | 15.5 | 8.4 | 11.1 |
| C-16 | 3.7 | 8.3 | 10.1 | 9.1 |

We claim:

1. A hybrid steel cord comprising, in contact with one or more carbon steel wire(s), at least one stainless steel wire whose microstructure contains less that 20% of martensite (% by volume).

2. A cord according to claim 1, in which the microstructure of the stainless steel comprises less than 5% of martensite or is martensite-free.

3. A cord according to claim 1, in which the carbon steel comprises between 0.68% and 0.95% of carbon (% by weight).

4. A cord according to claim 1, in which the stainless steel comprises less than 0.2% of carbon, between 16% and 20% of chromium, less than 10% of nickel and less than 2% of molybdenum (% by weight).

5. A cord according to claim 4, in which the stainless steel comprises less than 0.12% of carbon, between 17% and 19% of chromium, and less than 8% of nickel.

6. A cord according to claim 5, in which the stainless steel comprises at most 0.08% of carbon.

7. A cord according to claim 1, each steel wire of which has a diameter between 0.12 and 0.35 mm.

8. A cord according to claim 7, each carbon steel wire of which has been subjected to a final degree of deformation $\epsilon$ greater than 2, and preferably greater than 3.

9. A cord according to claim 8, each carbon steel wire of which has a tensile strength at least equal to 2000 MPa and preferably above 2500 MPa.

10. A cord according to claim 1, whose stainless steel wires are coated with a layer of nickel.

11. A cord according to claim 1, whose carbon steel or stainless steel wires are coated with a layer of brass.

12. A cord according to claim 1, each of whose carbon steel wires is in contact with at least one stainless steel wire.

13. A cord according to claim 1, in which at least 50% of the steel wires are carbon steel wires.

14. A cord according to claim 13, of the elementary strand type, with a structure (1×N) consisting of a group of N wires (N≦2) twisted together in a helix, each carbon steel wire being in contact with at least one stainless steel wire.

15. A cord according to claim 13, of the layered type, with a structure (X+Y+Z), consisting of a core of X wire(s) surrounded by at least a first layer of Y wires, itself possibly surrounded by a second layer of Z wires, preferably with X ranging from 1 to 4, Y from 3 to 12, and Z from 8 to 20, depending on the case.

16. A cord according to claim 15 of the layered type, whose central core includes at least one stainless steel wire surrounded by and in contact with at least a first layer of carbon steel wires.

17. A layered cord according to claim 16, with structure (1+6+11) or (1+6+12), whose central core includes one stainless steel wire surrounded by and in contact with a first layer of 6 carbon steel wires, itself surrounded by a second layer of 11 or 12 carbon steel wires, respectively.

18. A method for improving in a steel cord the resistance to fatigue-fretting-corrosion of one or more carbon steel wire(s), comprising, during the fabrication of the said cord, incorporating at least one stainless steel wire in it so as to be in contact with the said carbon steel wire(s).

19. A method according to claim 18, in which the microstructure of the stainless steel contains less than 20% of martensite (% by volume).

20. A method according to claim 19, in which the microstructure of the stainless steel contains less than 5% of martensite or is martensite-free.

21. An article made of plastic and/or rubber reinforced with a cord according to claim 1.

22. An article made of rubber according to claim 21, consisting of a carcass reinforcement ply for a tire envelope.

23. An article made of rubber according to claim 21, consisting of a tire envelope.

* * * * *